United States Patent [19]

Cavanagh

[11] 4,449,306

[45] May 22, 1984

[54] RUNNING SHOE SOLE CONSTRUCTION

[75] Inventor: Peter R. Cavanagh, Pine Grove Mills, Pa.

[73] Assignee: PUMA-Sportschuhfabriken Rudolf Dassler KG, Herzogenaurach, Fed. Rep. of Germany

[21] Appl. No.: 434,047

[22] Filed: Oct. 13, 1982

[51] Int. Cl.[3] ..... A43B 13/04; A43B 13/12; A43B 13/18

[52] U.S. Cl. ..... 36/30 R; 36/32 R; 36/35 R; D2/310

[58] Field of Search ..... 36/25 R, 30 R, 30 A, 36/31, 32 R, 114, 129, 35 R; D2/274, 309, 310

[56] References Cited

U.S. PATENT DOCUMENTS

| | | | |
|---|---|---|---|
| 3,221,422 | 12/1965 | Lemeshnik | 36/30 R |
| 3,664,040 | 5/1972 | Ouimet | 36/25 R |
| 4,240,241 | 12/1980 | Sigle et al. | 36/30 R |
| 4,241,523 | 12/1980 | Daswick | 36/32 R |
| 4,255,877 | 3/1981 | Bowerman | 36/68 |
| 4,309,832 | 1/1982 | Hunt | 36/32 R |

*Primary Examiner*—Werner H. Schroeder
*Assistant Examiner*—Steven N. Meyers
*Attorney, Agent, or Firm*—Antonelli, Terry & Wands

[57] ABSTRACT

An otherwise conventionally constructed running shoe sole is provided with a rounded border having a radius of curvature of about 20 mm only along approximately the rear 50% of the length of the outer side of the mid-sole and heel edge layers, the remaining border area being provided with a conventional flaring or the like with the exception of a transition zone. In accordance with a modified embodiment, a convexly curved shock-absorber bar is incorporated into the sole and is outwardly covered by a layer of softer material which is provided with the outer curvature, and which increases the cushioning capacity of the sole during initial heel strike.

20 Claims, 7 Drawing Figures

RUNNING SHOE SOLE CONSTRUCTION

BACKGROUND OF THE INVENTION

The present invention relates to the field of running shoes, and, in particular, to a sole construction for running shoes designed to reduce problems of excess "pronation" and heel wear.

As described in detail in my book entitled *The Running Shoe Book,* Anderson World, Inc., 1980, during running, initial contact between a runner's shoe and the ground occurs at the outside or lateral edge of the shoe and not the back edge thereof, as occurs during walking (see upper illustration, FIG. 4). After landing on the lateral border of the shoe, the foot and the shoe tend to shift quickly into a flat position (central illustration, FIG. 4). This flattening-out of the foot involves the subtalar joint (which is the joint between the talus and the heel bone). From the flat position, this side-to-side rolling motion then continues into a condition known as "pronation" (lower illustration, FIG. 4), wherein the foot is angled inwardly upon its inside edge. This side-to-side rolling movement into pronation causes trouble only when pronation does not stop within what is considered a normal range. Because pronation involves the rotation of the subtalar joint, it involves both the leg and the foot, with the result that the subtalar joint pronates, as the leg rotates inward. If there is too much pronation, a large amount of inward rotation will occur, and this will produce a screwing type of motion at the knee joint. Since the knee is not designed to resist this type of screwing motion, when excessive amounts of pronation occur, the runner's knee joint is likely to be injured.

To prevent side-to-side rolling of the foot during the support phase (flat position), lateral flaring of the sole of running shoes was introduced in 1975. Typical lateral flaring is shown in FIGS. 4 and 6, wherein it can be seen that the midsole starts out wide at the base and gradually tapers up toward the featherline where the sole is joined to the upper of the shoe. In my above-noted book, I pointed out that there was no reason that the flare should be symmetrical on the inside and outside border of the shoe, and that the outer flare could be reduced, because the most resistance is required on the inside to prevent inward rolling motion. Implementation of this idea can be seen in the FIG. 4 embodiment of U.S. Pat. No. 4,255,877, wherein the midsole is flared on the inner side of the heel, but the outer edge of the sole is squared.

Additionally, since the outside border of the shoe, and not the back edge, is the first in line to receive pressure at initial contact, the runner wearing a running shoe having a flared or squared outside edge is landing on a soft "knife edge" of the lateral border of the shoe, and a smooth transition between the contact and support phases is not likely to be achieved, particularly if the heel strike occurs somewhat outwardly of the actual edge. In this regard, this particular problem can, perhaps, be best visualized if the rolling motion is equated to that which occurs if a square cylinder or wheel is rolled about its longitudinal axis.

Furthermore, because of the above-noted location of initial heel contact with the ground, the most common location for outsole wear is the rear outside border of the shoe. This wear occurs, principally, when the foot first contacts the ground and relative movement occurs between the shoe and the ground, which produces a grinding effect that wears away the outside corner of the heel in the area indicated by the broken line in FIG. 5.

U.S. Pat. No. 4,241,523 shows a shoe that has an outer sole with a convex curvature for facilitating a rolling motion of the foot and the shoe after initial contact of the foot of the wearer with the ground. However, since this rocker provides a rolling about a laterally-extending axis at the rear of the heel, and since this rolling motion is produced by a rocker that is described as necessarily being relatively rigid and having only a limited amount of flexibility, the sole construction of this patent is unsuitable for running shoes. That is, due to the fact that heel strike occurs at the lateral outer edge of the heel and produces a side-to-side rolling of the foot (as opposed to the back-to-front rolling which occurs after heel strike during walking), the rocker utilized in accordance with this patent is ineffective with regard to this typical running motion, while the rigid construction of the rocker will inhibit satisfactory cushioning of the foot during heel strike.

SUMMARY OF THE INVENTION

In view of the foregoing, it is an object of the present invention to provide an improved sole for a running shoe, which will effectively act to inhibit excessive pronation.

It is a further object of the present invention to provide a sole for a running shoe which will exhibit improved wear characteristics.

It is yet another object of the present invention to provide a sole for a running shoe which obtains the preceding objects, while providing an effective cushioning during heel strike conditions.

It is still a further object of the present invention to obtain all of the above-noted benefits, while requiring a minimum of modifications to conventional running sole constructions.

These objects are achieved in accordance with preferred embodiments of the present invention by modifying an otherwise conventionally constructed running shoe sole with a rounded border having a radius of curvature of about 20 mm only along approximately the rear 50% of the length of the outer side of the midsole and heel wedge layers. With the exception of a transition zone, the remaining border area is provided with a conventional flaring or the like.

The rounded sole portion is designed to flatten more easily and more slowly during heel strike, so that there is less momentum carrying the foot into pronation. At the same time, this rounding of the sole also eliminates the square-wheel effect, so that the transition into the support phase occurs smoothly, and a grinding away of the outer corner of the heel is reduced through a reduction of the frictional forces experienced.

In accordance with a modified embodiment of the present invention, a convexly curved shock-absorber bar is applied to the rounded border and then a layer of softer material applied thereover. This outer layer of softer material is curved in the same manner, noted above, and increases the cushioning capacity of the sole during initial heel strike.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
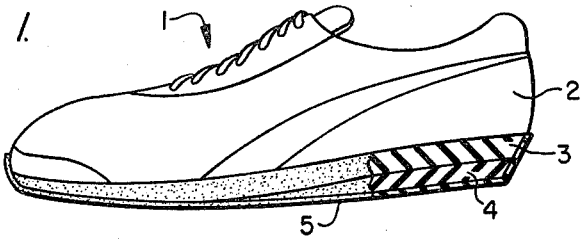
FIG. 1 is a side elevational view, partly in cross section, illustrating a conventional running shoe having a shoe sole construction in accordance with the present invention.
Figure 2:
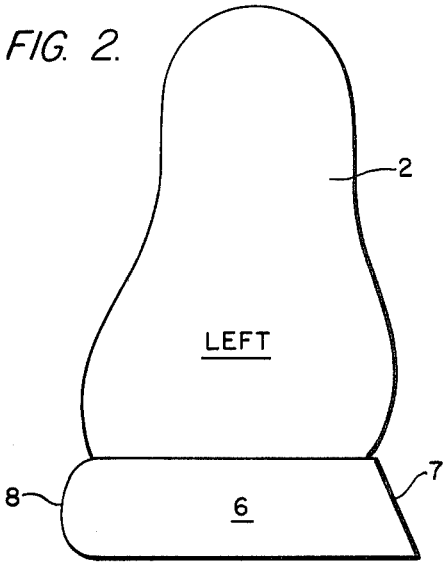
FIG. 2 is a schematic rear view of a left shoe provided with a rounded outer border in accordance with the present invention.

With reference to FIG. 1, wherein a running shoe 1, having a standard upper 2, is provided with a sole in accordance with the present invention, it can be seen that the sole has three basic layers. Closest to the upper is the midsole 3. In the rear approximately 50% of the shoe (from the arch rearwardly), a heel sole layer 4 supports the midsole. These layers 3, 4 are then covered externally on the bottom of the sole by a relatively thin, outer sole layer 5, which is wrapped upwardly onto the front of the toe region and rear of the heel region. While the outer sole 5 is of a hard, wear-resistant material, the midsole 3 and heel sole layer 4 are of a resilient cushioning material (such as a lightweight, synthetic foam having a 45–50 durometer hardness), thereby forming a cushioning sole layer. To the extent described so far, this running shoe sole construction is conventional in every respect.

Figure 5:
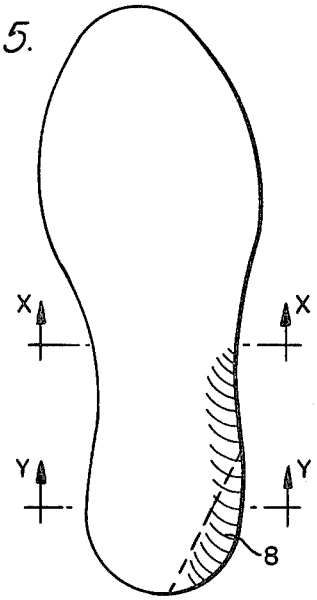
FIG. 5 is a schematic plan view of a sole in accordance with the present invention.
Figure 4:
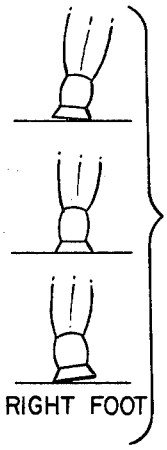
FIG. 4 is a schematic illustration depicting the side-to-side rolling motion which occurs between a shoe and the ground during running.
Figure 6:
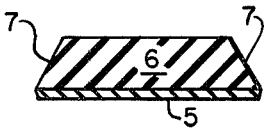
FIGS. 6 and 7 are schematic sectional views taken along lines X—X and Y—Y of FIG. 5.
Figure 7:
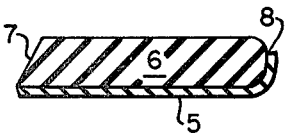

On the other hand, in a departure from the prior art, the cushioning sole layer of the running shoe sole construction of the present invention (which corresponds to midsole 3 and heel sole layer 4 of FIG. 1 or may be constructed, as represented schematically in FIGS. 2, 3, 6 and 7, as a unitary midsole layer having a heel lift portion equivalent to heel sole layer 4) is provided with a rounded border having a radius of curvature of about 20 mm only along approximately the rear 50% of the length of the outer side of the cushioning sole 6 as shown in FIG. 5. The remaining border area, forwardly of the arch of the sole, is provided with a conventional flaring 7 or the like, except for a transition zone at approximately 50% of the length of the sole, whereat the flaring 7 merges into the rounded curvature 8. Thus, as can be seen from FIG. 6, in the forward regions of the cushioning sole 6, both borders are flared, while, FIG. 7 shows in the rear half of the sole, the longitudinally-extending portion of the sole border at the inside of the foot is flared and the longitudinally-extending portion of the border of the sole at the outer side is provided with the curvature 8 of approximately 20 mm radius. However, while it is preferred, for manufacturing reasons, that the curvature 8 extend the full height of the cushioning sole 6, it will be sufficient if this curvature is terminated at a height equal to approximately 50% of the total height of the sole from its base at outer sole layer 5, instead of extending from the base to the featherline of the sole. In either case, since the rounded border contacts the ground, it is preferred that the thin outer sole layer 5 be extended laterally so as to come up over the cushioning sole layer at least in the area of curvature 8. Likewise, it is also contemplated that the flaring in the front half of the sole along the outer side thereof may be less pronounced than that on the inner side of the sole, or may even be relatively squared.

Figure 3:
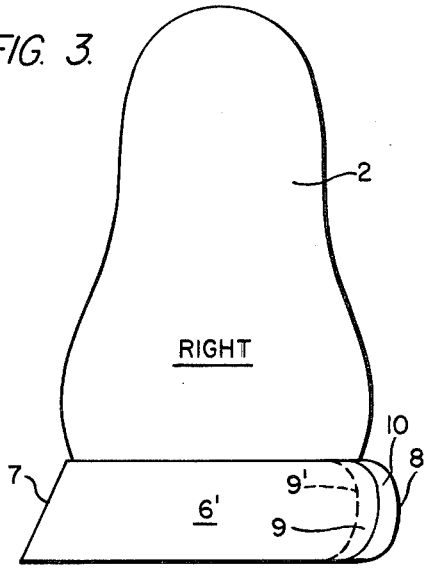
FIG. 3 is a schematic rear view of a right shoe equipped with a modified form of a rounded shoe sole construction in accordance with the present invention.

Turning now to FIG. 3, a modified embodiment of the present invention will be described. In accordance with this embodiment, a curved, shock-absorber plate or bar 9 is incorporated into the sole paralleling the curved border 8. Inwardly of the shock-absorber plate 9, cushioning sole 6' is constructed in the same manner described above for cushioning sole 6. However, outwardly of the shock-absorbing plate 9, a curved layer 10 of material which is significantly softer than the 45–50 durometer cushioning material, such as used for cushioning sole 6 or 6', thereby further increasing shock-absorbancy during heel strike. As shown in FIG. 3, shock-absorber plate 9 extends from the base to the featherline at a point corresponding to border 8 in the FIG. 2 embodiment. However, this should be considered as preferably the outermost location for such a shock-absorber plate, which may be shifted to a position inwardly underneath the outer edge of the upper, such as shown at 9', in which case portion 10 of softer material would be shifted appropriately so that, for example, it might occupy the zone between the positions of bar 9' and 9. It is still further pointed out that the size and resiliency of portion 10 and the resiliency of plate 9 need not have any specific values so long as they are coordinated together to ensure adequate shock-absorbancy and support for the foot under anticipated running conditions.

In accordance with all of the above-described embodiments, the rounded sole portion 8 will flatten more easily and more slowly during heel strike than soles provided with a conventional flaring or the like in the noted region between the arch and the end of the heel, so that there is less momentum carrying the foot into pronation, while, as the same time, transition of the foot into the support phase occurs smoothly without a square-wheel effect and with grinding away of the outer corner of the sole being reduced through a reduction of the frictional forces experienced. Furthermore, it should be appreciated that the construction according to the present invention does not require a manufacturer to implement major changes in his manufacturing techiques to adopt same.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A running shoe sole construction comprising a cushioning sole layer having a midsole layer and a heel lift portion, and an outer sole layer covering the bottom of the cushioning sole layer, said midsole layer and heel lift portion being formed of resilient cushioning material and said outer sole layer being formed of a relatively hard, wear-resistant material, wherein the circumferentially-extending border of the sole construction is provided with a convexly curved shape having a relatively large radius of curvature located along at least a heel area of an outer, longitudinally-extending, side of the cushioning sole layer and is provided with a flaring or the like at an inner longitudinally-extending side of the cushioning sole layer.

2. A running shoe sole construction according to claim 1, wherein the convexly curved shape of the border does not extend forwardly of a sole arch area.

3. A running shoe sole construction according to claim 1, wherein said convexly curved shape extends at least 50% of the height from said outer sole layer to a featherline area of the sole construction.

4. A running shoe sole construction according to claim 2, wherein a flaring or the like is provided forwardly of said convexly curved shape along said outer longitudinally-extending side.

5. A running shoe sole construction according to claim 4, wherein said convexly curved shape merges into said flaring or the like in a transition area disposed at approximately 50% of the length of the sole construction.

6. A running shoe sole construction according to claim 5, wherein said convexly curved shape extends over substantially the full height of said cushioning sole layer.

7. A running shoe sole construction according to claim 6, wherein said cushioning sole layer is provided with an arcuate flexible shock-absorber member paralleling said convexly curved shape at a position inwardly thereof.

8. A running shoe sole construction according to claim 7, wherein said flexible shock-absorber member extends substantially the full length of the convexly curved shape.

9. A running shoe sole construction according to claim 8, wherein said shock-absorber member is covered laterally outwardly by a layer of soft material having greater cushioning properties than the midsole layer and heel lift portion, which are located laterally inwardly thereof, said soft material being provided with said convexly curved shape.

10. A running shoe sole construction according to claim 7, wherein said shock-absorber member is covered laterally outwardly by a layer of soft material having greater cushioning properties than the midsole layer and heel lift portion, which are located laterally inwardly thereof, said soft material being provided with said convexly curved shape.

11. A running shoe sole construction according to claim 3, wherein said heel lift portion and said midsole layer of said cushioning sole layer are separate layers.

12. A running shoe sole construction according to claim 3, wherein said heel lift portion is a unitarily formed part of said midsole layer.

13. A running shoe sole construction according to claim 9, wherein said midsole layer and heel lift portion are formed of a foamed plastic material of approximately 45–50 durometer.

14. A running shoe sole construction according to claim 1, wherein the radius of curvature of said convexly curved shape is about 20 mm.

15. A running shoe sole construction according to claim 1, wherein said outer sole layer is relatively thin and extends laterally so as to come up along the convexly curved shape of the border of the sole construction.

16. A running shoe sole construction according to claim 2, wherein said outer sole layer is relatively thin and extends laterally so as to come up along the convexly curved shape of the border of the sole construction.

17. A running shoe sole construction according to claim 4, wherein said outer sole layer is relatively thin and extends laterally so as to come up along the convexly curved shape of the border of the sole construction.

18. A running shoe sole construction according to claim 5, wherein said outer sole layer is relatively thin and extends laterally so as to come up along the convexly curved shape of the border of the sole construction.

19. A running shoe sole construction according to claim 6, wherein said outer sole layer is relatively thin and extends laterally so as to come up along the convexly curved shape of the border of the sole construction.

20. A running shoe sole construction according to claim 9, wherein said outer sole layer is relatively thin and extends laterally so as to come up along the convexly curved shape of the border of the sole construction.

* * * * *